US006470912B1

(12) United States Patent
Haynes

(10) Patent No.: US 6,470,912 B1
(45) Date of Patent: Oct. 29, 2002

(54) DUAL-SPOOL HYDRAULIC DIRECTIONAL VALVE

(75) Inventor: Gary A. Haynes, Mansfield, TX (US)

(73) Assignee: Arlington Automatics, Inc., Grand Prairie, TX (US)

( * ) Notice: Subject to any disclaimer, the term of this patent is extended or adjusted under 35 U.S.C. 154(b) by 0 days.

(21) Appl. No.: 09/552,904

(22) Filed: Apr. 20, 2000

(51) Int. Cl.[7] ..... F15B 13/08
(52) U.S. Cl. ..... 137/596; 137/596.12; 137/596.2
(58) Field of Search ..... 137/596.12, 596.1, 137/596.2, 596

(56) References Cited

U.S. PATENT DOCUMENTS

| | | | | | |
|---|---|---|---|---|---|
| 1,606,426 | A | * | 11/1926 | Justen | 137/596.2 |
| 2,477,237 | A | * | 7/1949 | Carr | 137/596.1 |
| 2,970,613 | A | * | 2/1961 | Baines | 137/596.12 |
| 3,304,953 | A | * | 2/1967 | Wickline et al. | 137/596.12 |
| 4,033,314 | A | | 7/1977 | Walton | 123/139 R |
| 4,057,005 | A | | 11/1977 | Ring | 91/413 |
| RE30,517 | E | * | 2/1981 | McClockin | 137/596.12 |
| 4,884,401 | A | | 12/1989 | Metcalf et al. | 60/403 |
| 5,613,641 | A | | 3/1997 | Grothen | 239/731 |
| 5,845,678 | A | * | 12/1998 | Ishihama et al. | 137/596 |
| 5,921,279 | A | | 7/1999 | Barber | 137/596.16 |

* cited by examiner

*Primary Examiner*—A. Michael Chambers
(74) *Attorney, Agent, or Firm*—Standley & Gilcrest LLP

(57) ABSTRACT

A dual-spool hydraulic directional valve for controlling the motion of a hydraulic cylinder or similar device. The dual-spool hydraulic directional valve of the present invention is less costly to manufacture, may be more easily repaired, and is more resistant to contamination than current hydraulic directional valves. The dual-spool hydraulic directional valve of the present invention is particularly suited to applications where the valve is not required to hold a load. The valve of the present invention uses two valve spools, with each valve spool controlling flow of hydraulic fluid through a particular port or ports. The valve spools work independently from one another, therefore, the slight leakage of hydraulic fluid from one valve spool to the other will not markedly affect the operation of the valve. In a preferred embodiment of the valve, a lever is utilized to shift the positions of the respective valve spools, although other means, such as electronic solenoids may also be used.

57 Claims, 12 Drawing Sheets

DUAL-SPOOL HYDRAULIC DIRECTIONAL VALVE

BACKGROUND AND SUMMARY OF THE INVENTION

The present invention relates to a hydraulic directional valve for controlling the motion of a hydraulic cylinder or similar device, and more particularly to such a hydraulic directional valve having two valve spools. Hydraulic directional valves are well known in general. Typically, such valves have a single valve spool that is precisely machined to a close tolerance with the surrounding valve body. Close tolerances are generally required to prevent the leakage of pressurized hydraulic fluid past the valve spool when the spool is shifted in one direction or the other. Any leakage prevents maximum hydraulic pressure from reaching a device connected to the valve, and additionally, if the valve is used to hold a device in position, leakage may allow the device to creep.

Hydraulic directional valves are typically operated by manually moving an actuator, such as a lever, or may also be operated by means of an electronic solenoid. In a typical single-spool valve, operation is accomplished by shifting the valve spool in one direction or the other to allow pressurized hydraulic fluid to travel through a certain port or ports in the valve body, while blocking access to other ports. Many of these valves may also possess a center, or neutral position, where pressurized hydraulic fluid is allowed to enter the valve body and then routed directly back to a hydraulic tank that is part of the hydraulic system to which the valve is connected. Alternatively, such valves may also have a center position wherein certain ports are blocked. In this case, when the valve spool is moved to the center position, any hydraulic fluid that has passed through the valve body to the device connected to the valve is trapped between the device and the valve. This allows pressure to remain in the line connecting the device to the valve. In this latter embodiment, it is especially important that leakage between the valve spool and valve body is minimized. Any such leakage will allow the hydraulic pressure between the valve and the device to diminish, leading to movement of the device or a loss of force exerted thereby.

The requirement of close tolerances is problematic in several respects. First, close tolerance machining is costly and results in a significant increase in the price of a valve manufactured in such a manner. Second, such valves are difficult to repair properly because the original valve spools are matched to the valve body in which they are installed. The likelihood of a replacement valve spool fitting an arbitrary valve body is low. Additionally, these valves are typically very sensitive to contamination. Because of the close tolerances required, even small amounts of contamination can effect shifting of the valve spool or contribute to leakage between the valve spool and the valve body.

Therefore, a need exists for a hydraulic directional valve that is less costly to manufacture, that may be more easily repaired, and that is more resistant to contamination than current hydraulic directional valves. The present invention discloses such a valve. The dual-spool hydraulic directional valve of the present invention is particularly suited to applications where the valve is not required to hold a load. The valve of the present invention uses two valve spools, with each valve spool controlling flow of hydraulic fluid through a particular port or ports. The valve spools work independently from one another, therefore, the slight leakage of hydraulic fluid from one valve spool to the other will not markedly affect the operation of the valve. By utilizing dual valve spools, the valve of the present invention may be manufactured without the need for the close tolerances typically required between the valve spool and the valve body. The valve may also be more easily and successfully repaired, and is less likely to effected by contamination.

In a preferred embodiment of the valve, a lever is utilized to shift the positions of the respective valve spools, although other means, such as electronic solenoids may also be used. Movement of the lever in one direction will allow the flow of pressurized hydraulic fluid through a predetermined port or ports associated with the active spool, while blocking the flow of hydraulic fluid through the port or ports associated with the inactive spool. Movement of the lever in the opposite direction will reverse the role of the respective spools. Preferably, the valve of the present invention will also have a center, or neutral position, wherein hydraulic fluid may flow through the valve body and back to a hydraulic tank without passing to any device connected to the valve.

BRIEF DESCRIPTION OF THE DRAWINGS

In addition to the novel features and advantages mentioned above, other objects and advantages of the present invention will be readily apparent from the following descriptions of the drawings and preferred embodiments, wherein.

DETAILED DESCRIPTION OF THE PREFERRED EMBODIMENT(S)

Figure 1:
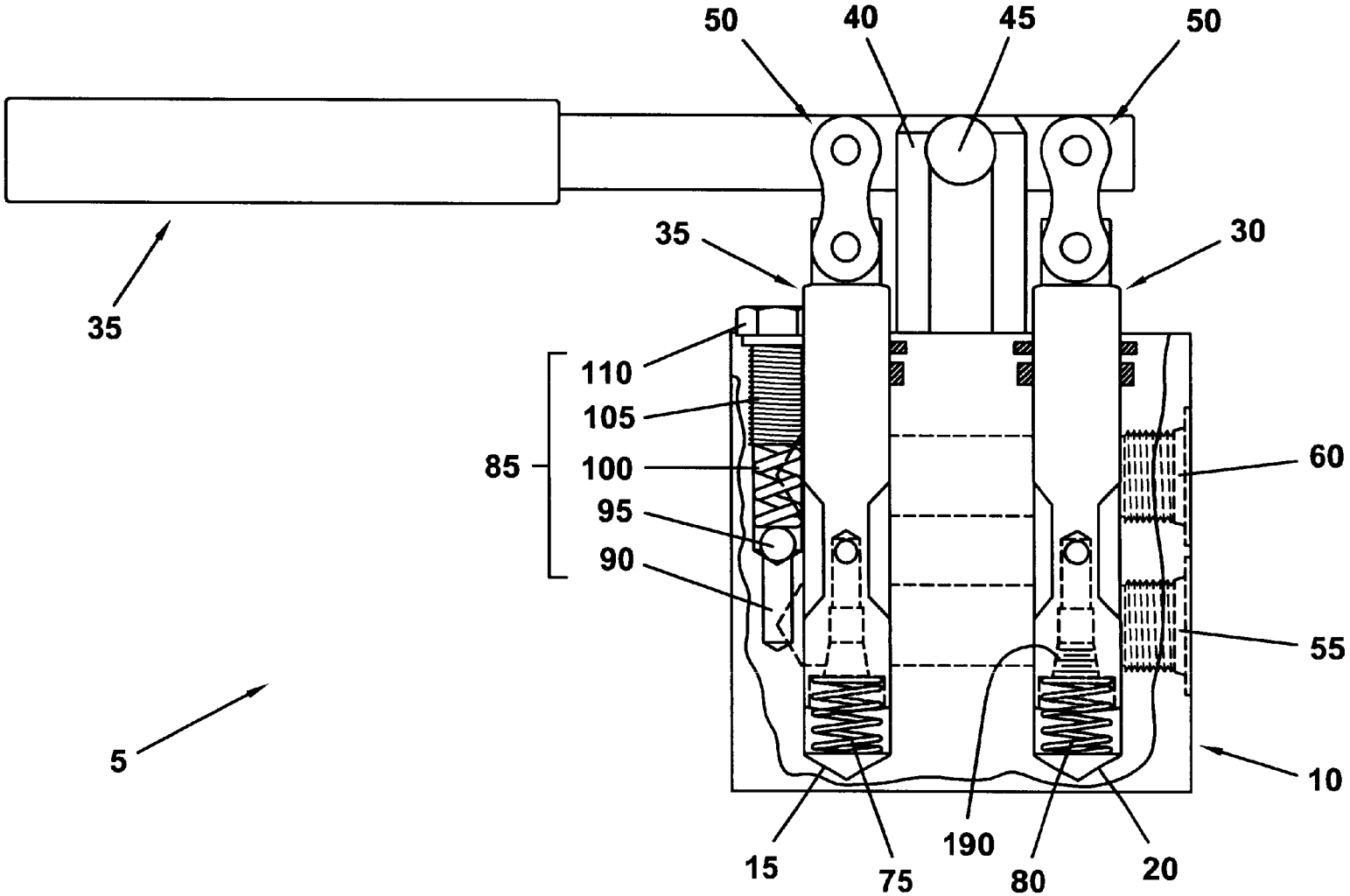
FIG. 1 is a front view of a preferred embodiment of an assembled, dual-spool hydraulic directional valve of the present invention.

A front view of a preferred embodiment of the dual-spool hydraulic directional valve 5 of the present invention can be seen by reference to FIG. 1. The directional valve 5 can be seen to have a valve body 10 that houses the internal components of the valve. The valve body 10 has a first bore 15 for receiving a first valve spool 25 and a second bore 20 for receiving a second valve spool 30. Each valve spool 25, 30 is biased upward by a spring 75, 80 residing in the bottom portion of the two bores 15, 20. The valve body 10 can also be seen to have a supply and return passageway, or port 55, 60 and two outlet passageways, or ports 65, 70 (FIG. 2) for allowing the passage of hydraulic fluid through the valve body.

A handle 35 is pivotally connected to each of the valve spools 25, 30 by a linkage 50. The handle 35 is also pivotally connected to the valve body 10 by means of a clevis 40, which is affixed to the valve body, and a clevis pin 45. Pushing down on the handle 35 will cause rotation of the handle about the clevis pin 45, forcing the first valve spool 25 further into the valve body 10 while simultaneously withdrawing a portion of the second valve spool 30 from the valve body. Conversely, lifting up on the handle 35 will have the reverse effect on the respective valve spools 25, 30.

The directional valve 5 can also be seen to have a pressure relief valve 85, for routing hydraulic fluid out of the directional valve and back to a hydraulic tank, for example, should the hydraulic pressure within the valve exceed a predetermined limit. The pressure relief valve 85 is formed by creating a bore 90 of differing diameters within the valve body 10, such that the bore 90 is in communication with the supply and return ports 55, 60. A steel ball 95 is placed within the bore 90 to seal off the lower, or smaller diameter portion thereof. A spring 100 of a predetermined strength is also placed within in the bore 90 to reside against the steel ball 95. A set screw 105 is then threaded into the top, threaded portion of the bore 90 and tightened against the spring 100 to keep pressure against the steel ball 95. The bore 90 is preferably sealed from leakage by a threaded steel O-ring 110, although other types of seals may also be employed. If the hydraulic pressure in the valve body 10 exceeds a predetermined limit, the hydraulic pressure will force the steel ball 95 upward, compressing the spring 100 and allowing hydraulic fluid to pass through the pressure relief valve bore 90, and out the return port 60.

Figure 2:
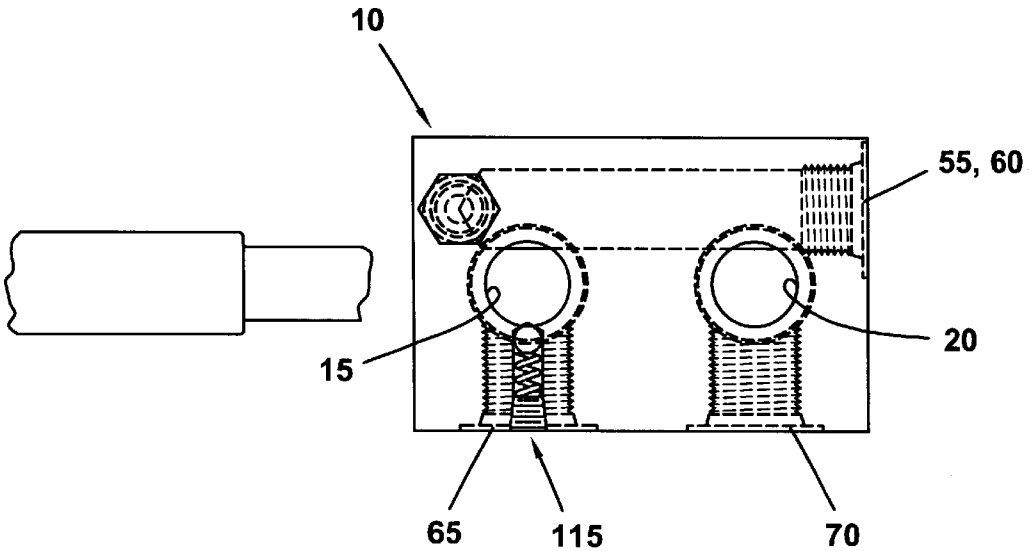
FIG. 2 is a top view of the preferred embodiment of FIG. 1.

A top view of the dual-spool hydraulic directional valve 5 of FIG. 1 is illustrated in FIG. 2. For purposes of clarity, the dual-spool hydraulic directional valve 5 is shown in FIG. 2 without the handle 35 and its connecting components. Supply port 55 and return port 60 can be seen to be in communication with the bores 15, 20 containing the valve spools 25, 30. The retract port 65 and the extend port 70 can be seen to be aligned with the valve spools 25 and 30 respectively.

Figure 3:
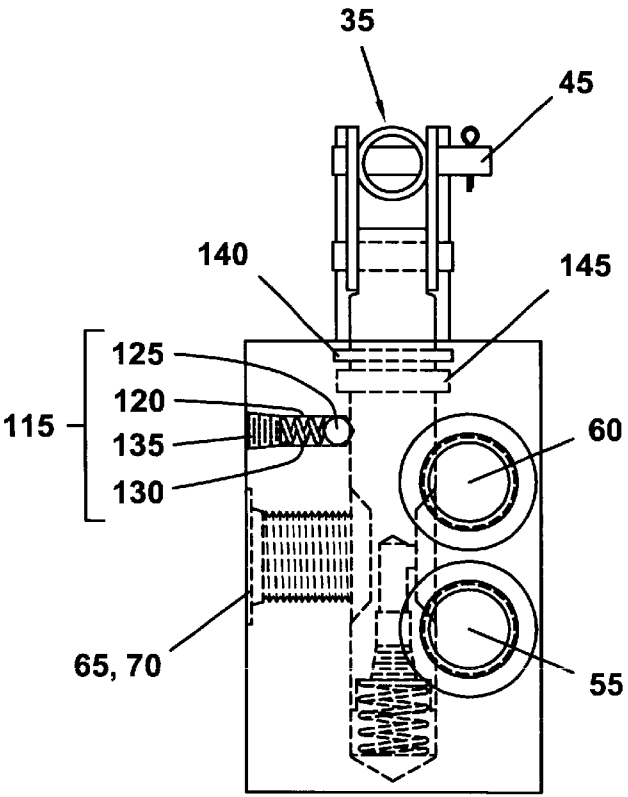
FIG. 3 is a right side view of the preferred embodiment of FIG. 1.

FIG. 3 depicts a right side view of the dual-spool hydraulic directional valve 5 shown in FIG. 1. The retract and extend ports 65, 70 can be seen to be aligned. A detent device 115 is provided to engage with a notch 185 located in at least one of the valve spools 25, 30 (see below and FIG. 4). The detent device 115 is constructed by placing a bore 120 in the valve body 10, such that the center of the bore is substantially in line with the longitudinal axis of the first bore 15. A steel ball 125 is placed within the bore 120 to reside against the first valve spool 25 when the first valve spool is within the first bore 15. A spring 130 is placed within the bore 120 to reside against the steel ball 125. An outer portion of the bore 120 is threaded 135 to accept a plug for biasing the spring 130 and steel ball 125 against the first valve spool 25, and for retaining the spring and steel ball within the bore.

The dual-spool hydraulic directional valve 5 may employ a wiper 140 within the bores 15, 20 for cleaning debris from the valve spools 25, 30 as the valve spools travel up and down within the bores. A seal 145, such as an o-ring, is also preferably utilized to prevent any hydraulic fluid passing through the gap between the surface of the valve spools 25, 30 and the surface of the bores 15, 20 from escaping from the valve body 10.

Figure 4:
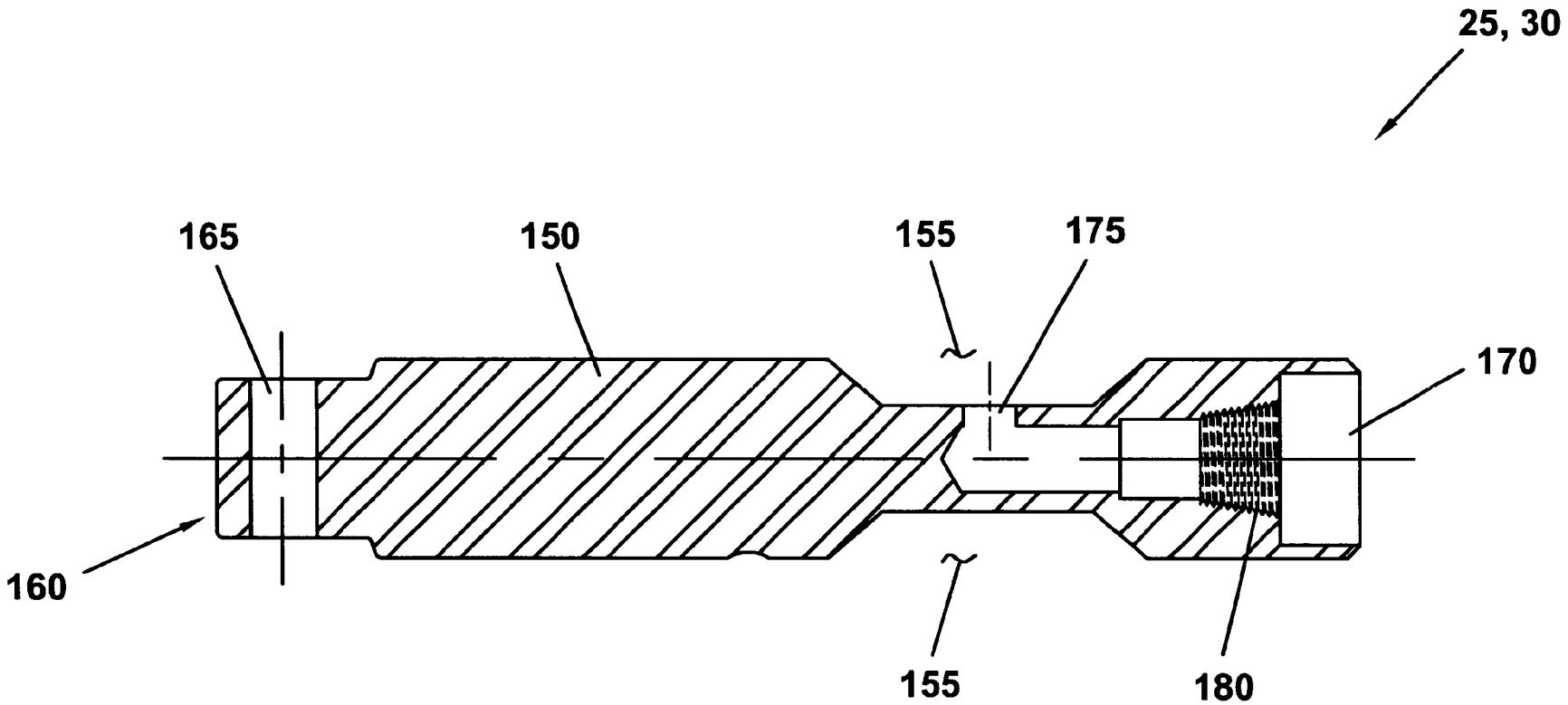
FIG. 4 is an enlarged cross-section of the valve spool seen in the preferred embodiments of FIGS. 1 and 3.
Figure 5:
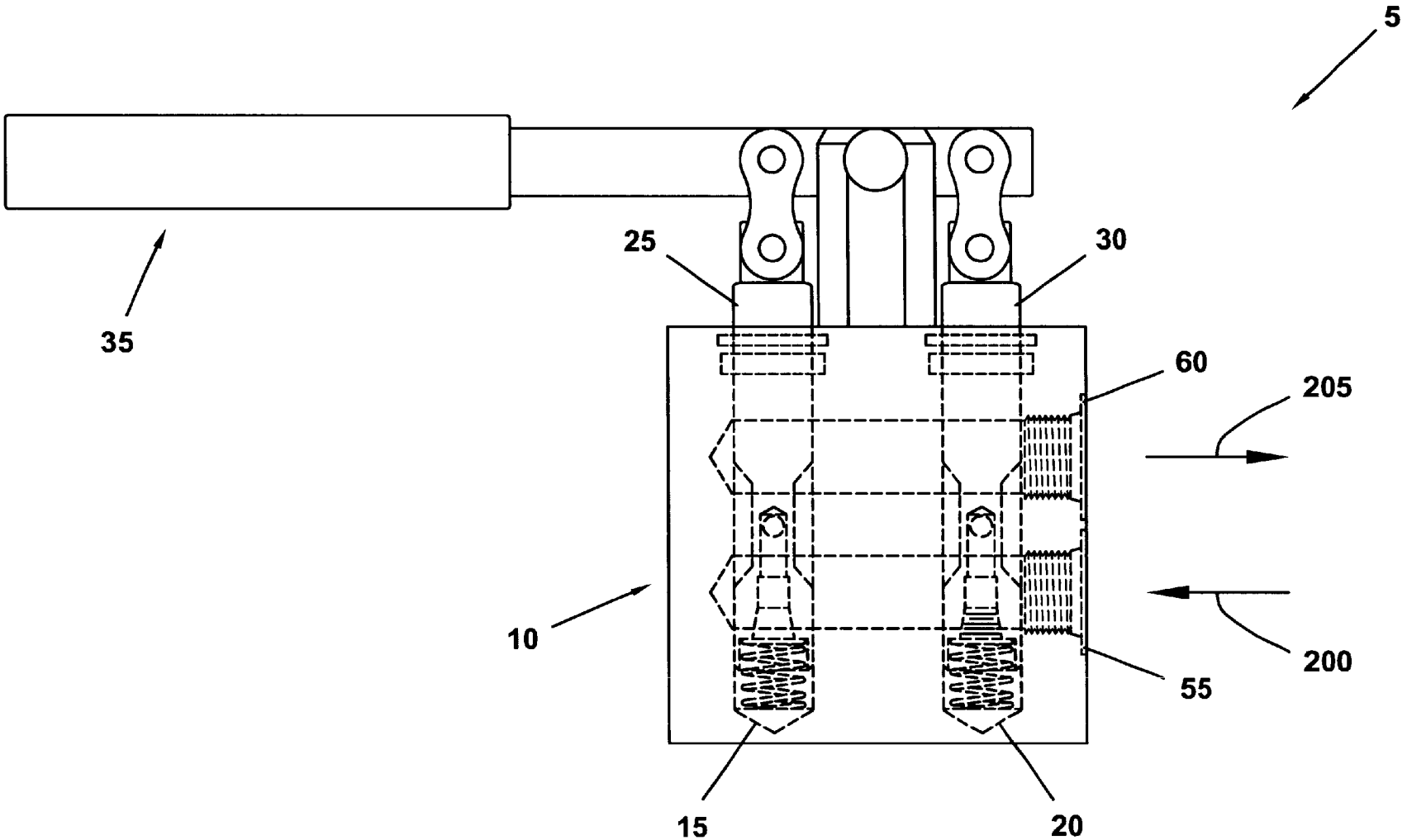
FIG. 5 illustrates the preferred embodiment of the dual-spool hydraulic directional valve of FIG. 1, wherein the valve is in a neutral position.

FIG. 4 illustrates, in a section view, a preferred embodiment of the valve spools 25, 30 of the present invention. The valve spools 25, 30 can be seen to have a cylindrical main body portion 150. A channel 155 or groove is formed around the circumference of the valve spools 25, 30, at a location such that the channel resides substantially between supply port 55 and return port 60 when the dual-spool hydraulic directional valve 5 is in a neutral position (FIG. 5). The channel 155 allows hydraulic fluid to pass more freely around the body of the valve spools 25, 30.

The top portion 160 of the valve spools 25, 30, which is preferably of slightly smaller diameter than the main body 150, contains a hole 165 which passes completely through the top portion along a diameter of the valve spools. The hole 165 is provided to receive a pin portion of the linkage 50 that connects the valve spools 25, 30 to the handle 35.

A counterbore 170 is preferably provided in the bottom of each valve spool 25, 30. The counterbore 170, which is centered about the axis of the valve spool, protrudes partially into the valve spools 25, 30, and is of a diameter slightly smaller than the diameter of the main body portion 150. The counterbore 170 is provided in each valve spool 25, 30 to retain a biasing spring 75, 80, which resides between the bottom of each valve spool and the bottom of the respective bores 15, 20. The biasing springs 75, 80 serve to influence each of the valve spools 25, 30 toward the neutral position (FIG. 5).

Figure 7:
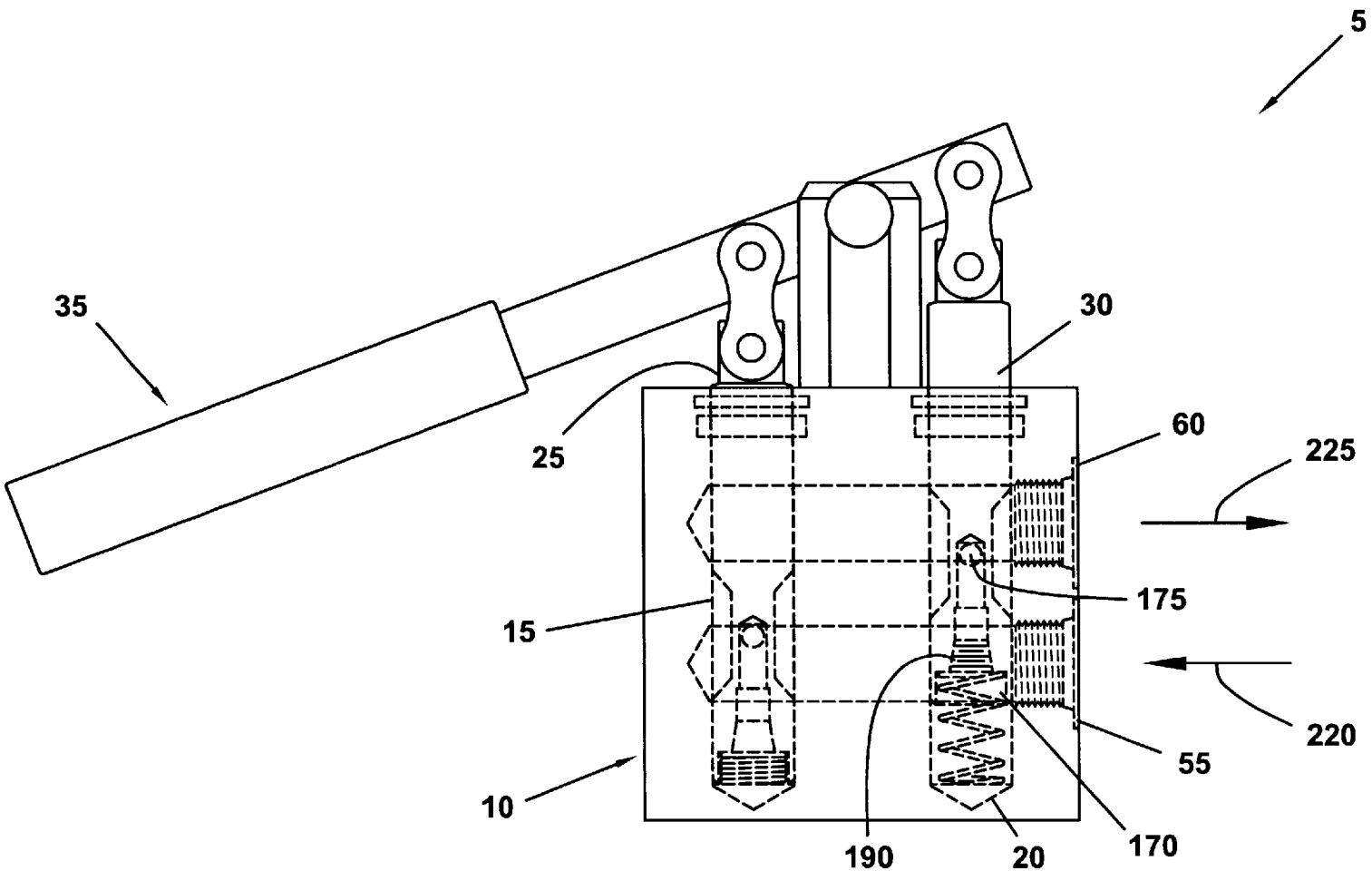
FIG. 7 illustrates the preferred embodiment of the dual-spool hydraulic directional valve of FIG. 1, wherein the valve is in a retract position.

A passageway 175 preferably extends axially from the counterbore 170 to substantially the centerline of the channel 155 on each valve spool 25, 30. The passageway 175 then extends in a direction transverse to the axis of the valve spool and exits into the channel 155. The passageway 175 allows hydraulic fluid to pass from the channel 155 in the first valve spool 25 into a portion of the bore 15 below the first valve spool, when the dual-spool hydraulic directional valve 5 is placed in the retract position (FIG. 7). This allows hydraulic pressure to build-up below the first valve spool 25, which assists the biasing spring 75 in returning the dual-spool hydraulic directional valve 5 to the neutral position upon full retraction of the hydraulic cylinder or similar device connected thereto.

A threaded segment 180 may be provided in the portion of the passageway 175 connecting to the counterbore 170. The threaded segment 180 allows a plug (not shown in FIG. 4) to be placed in the passageway 175 for blocking the transmission of hydraulic fluid to the lower portion of the second bore 20. A plug 190 is represented in the valve spool 30 shown in FIG. 1. Although in the preferred embodiment of the invention depicted in FIGS. 1–7, both valve spools 25, 30 are shown to have the counterbore 170 and passageway 175, it is also possible to utilize a valve spool without these elements as a substitute for the second valve spool 30 containing the plug 190.

The first valve spool 25 also preferably contains a notch 185 for engaging with the detent device 115 shown in FIG.

3. The detent device 115 and notch 185 serve to help retain the position of the first valve spool 25 when the dual-spool hydraulic directional valve 5 is in the retract position (FIG. 7).

The dual-spool hydraulic directional valve 5 can be seen in a "neutral" position by reference to FIG. 5. In the neutral position, the handle 35 is approximately parallel with the top surface of the valve body 10, such that the valve spools 25, 30 protrude into the valve body approximately an equivalent amount. In this position, hydraulic fluid from a pressurized source, such as a hydraulic pump, flows into the valve body 10 through inlet port 55, as illustrated by arrow 200. Pressure exists in the lines (not shown) leading from the retract and extend ports 65, 70 to the hydraulic cylinder or other device connected to the valve 5. Because the pathway through the bores 15, 20 to the return port 60 provides the path of least resistance, substantially all of the hydraulic fluid entering inlet port 55 will exit through the return port 60 back to the hydraulic tank. In the neutral position, hydraulic fluid may freely circulate from a hydraulic pressure source through the dual-spool hydraulic directional valve 5 without actuating any hydraulic devices attached thereto.

Figure 6:
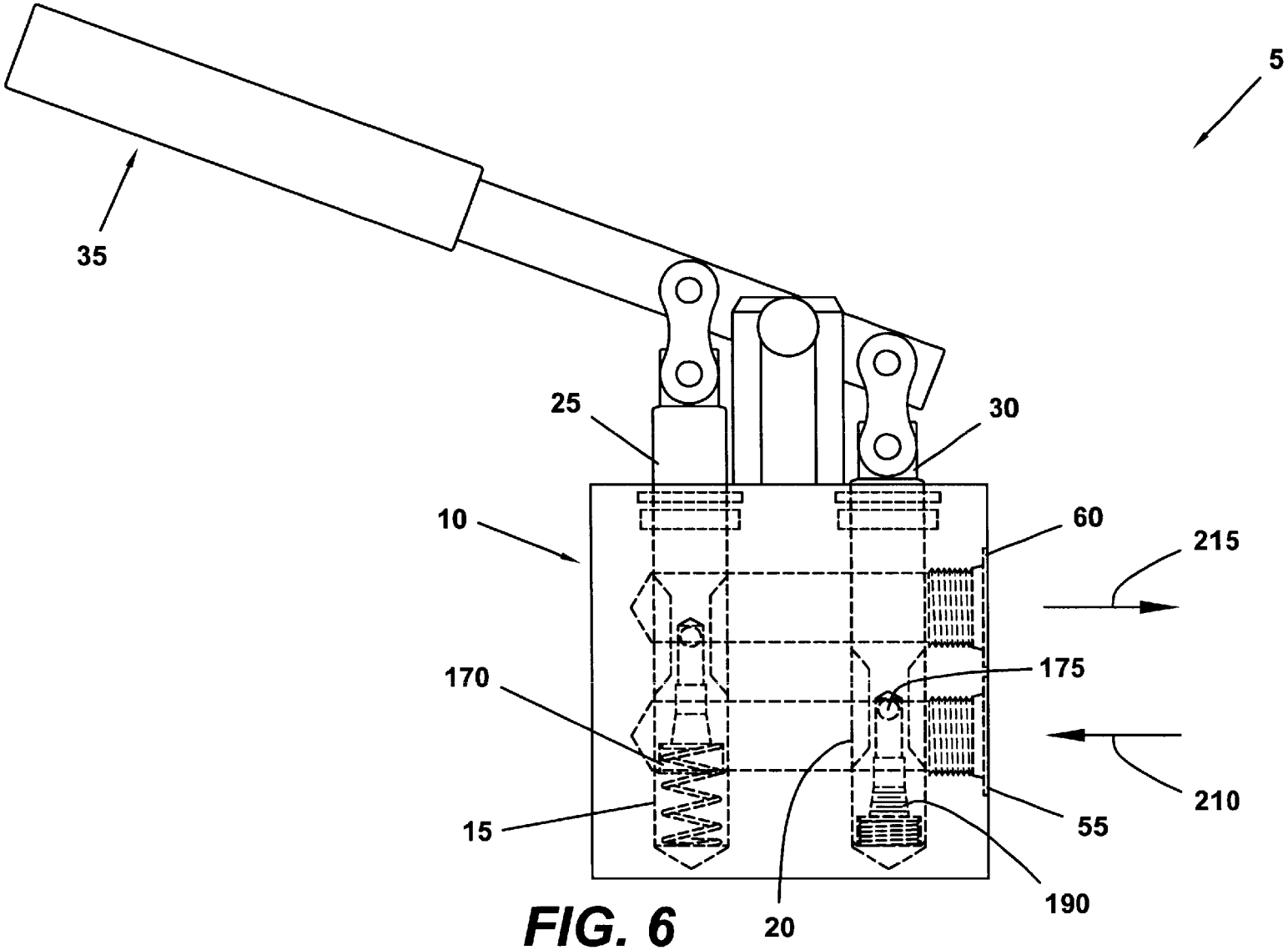
FIG. 6 illustrates the preferred embodiment of the dual-spool hydraulic directional valve of FIG. 1, wherein the valve is in an extend position.

FIG. 6 shows the dual-spool hydraulic directional valve 5 in an "extend" position. In the extend position, the handle 35 is raised, causing the first valve spool 25 to become partially removed from the valve body 10, and simultaneously driving the second valve spool 30 further into the valve body. Hydraulic fluid from a pressurized source, such as a hydraulic pump, flows into the valve body 10 through the inlet port 55, as illustrated by arrow 210. The majority of the hydraulic fluid will flow around the channel 155 of the second valve spool 30, and out the extend port 70. The hydraulic fluid is prohibited from entering the return port 60 by an upper portion of the second valve spool 30. The hydraulic oil will also flow into the passageway 175, but is prevented, in this particular embodiment of the present invention, from exiting the counterbore 170 by a threaded plug 190.

A portion of the hydraulic fluid entering supply port 55 will flow past the second valve spool 30 to the first valve spool 25. However, the hydraulic fluid is prohibited from entering the first bore 15 by a lower portion of the first valve spool 25. Likewise, the lower portion of the first valve spool 25 prevents hydraulic fluid returning to the directional valve through retract port 65 from entering the supply port 55 through the first bore 15. The returning hydraulic fluid is also prevented from passing to the extend port 70, via the return port 60, by an upper portion of the second valve spool 30. Thus, the returning hydraulic fluid flows into the retract port 65 and out through the return port 60, as illustrated by arrow 215.

FIG. 7 illustrates the dual-spool hydraulic directional valve 5 in a "retract" position. In the retract position, the handle 35 is depressed, causing the second valve spool 30 to become partially removed from the valve body 10, and simultaneously driving the first valve spool 25 further into the valve body. In this position, the detent device 85 will engage with the notch 185 in the first valve spool to help retain the first valve spool in the retract position.

Hydraulic fluid from a pressurized source, such as a hydraulic pump, flows into the valve body 10 through inlet port 55, as illustrated by arrow 220. The hydraulic fluid is prevented from entering the second bore 20 by a lower portion of the second valve spool 30. The hydraulic fluid will flow past the second valve spool 30 and to the first bore 15. The hydraulic fluid will enter the first bore 15, flow around the channel 155 of the first valve spool 25, and out the retract port 65. The hydraulic fluid is prevented from entering the return port 60 through the first bore 15 by an upper portion of the first valve spool 25.

In this preferred embodiment, the hydraulic fluid entering the first bore 15 will also flow into the passageway 175 of the first valve spool 25, and exit the counterbore 170 into the bottom portion of the first bore 15. The hydraulic fluid which flows into the bottom portion of the first bore 15 assists in returning the first valve spool 25 to the neutral position (see FIG. 5) once sufficient pressure has built.

Hydraulic fluid returns to the dual-spool hydraulic directional valve 5 from the extending side of the hydraulic device connected thereto through extend port 70. This returning hydraulic fluid is prevented from entering the supply port 55 by a lower portion of the second valve spool 30. Likewise, once the returning hydraulic fluid enters return port 60, it is prohibited from flowing into the first bore 15 by an upper portion of the first valve spool 25. Thus, the returning hydraulic fluid will exit the directional valve 5 through the return port 60, as illustrated by arrow 225.

Figure 8:
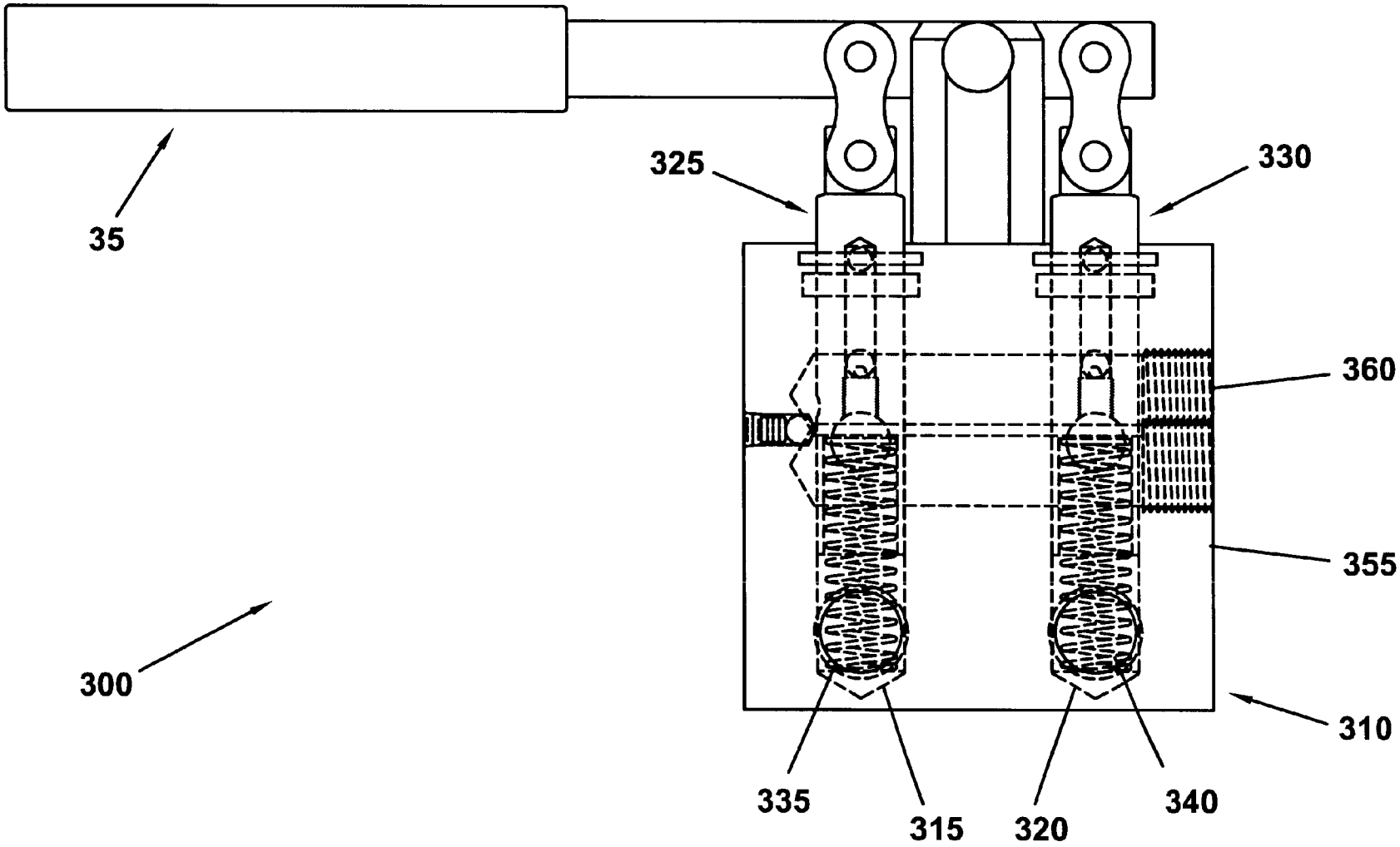
FIG. 8 is a front view of an alternate embodiment of an assembled, dual-spool hydraulic directional valve of the present invention.

An alternate embodiment of the dual-spool hydraulic directional valve 300 of the present invention may be seen in FIGS. 8–14. Referring to FIG. 8, the directional valve 300 can be seen to have a valve body 310 that houses the internal components of the valve. The valve body 310 has a first bore 315 for receiving a first valve spool 325 and a second bore 320 for receiving a second valve spool 330. Each valve spool 325, 330 is biased upward by a spring 335, 340 residing in the bottom portion of the two bores 315, 320. The valve body 310 can also be seen to have a supply and return port 355, 360 and two outlet ports 365, 370 (FIG. 9) for allowing the passage of hydraulic fluid through the valve body.

A handle 35 is pivotally connected to each of the valve spools 325, 330 by a linkage 50. The handle 35 is also pivotally connected to the valve body 310 by means of a clevis 40, which is affixed to the valve body, and a clevis pin 45. Pushing down on the handle 35 will cause rotation of the handle about the clevis pin 45, forcing the first valve spool 325 into the valve body 310 while simultaneously withdrawing the second valve spool 330 from the valve body. Conversely, lifting up on the handle 35 will have the reverse effect on the respective valve spools 325, 330.

A detent device 375 is provided to engage with a notch 400 located in the first valve spool 325 (see below and FIG. 4), as the first valve spool is forced into the valve body 310 when the valve 300 is placed in a retract position. The detent device 375 is constructed by placing a bore 380 in the valve body 310, such that the center of the bore is substantially in line with the longitudinal axis of the first bore 315. A steel ball 385 is placed in the bore 380 to reside against the first valve spool 325 when the first valve spool is within the first bore 315. A spring 390 is placed in the bore 380 to reside against the steel ball 385. An outer portion of the bore 380 is threaded 395 to accept a plug for biasing the spring 390 and steel ball 385 against the first valve spool 325, and for retaining the spring and steel ball within the bore.

Figure 9:
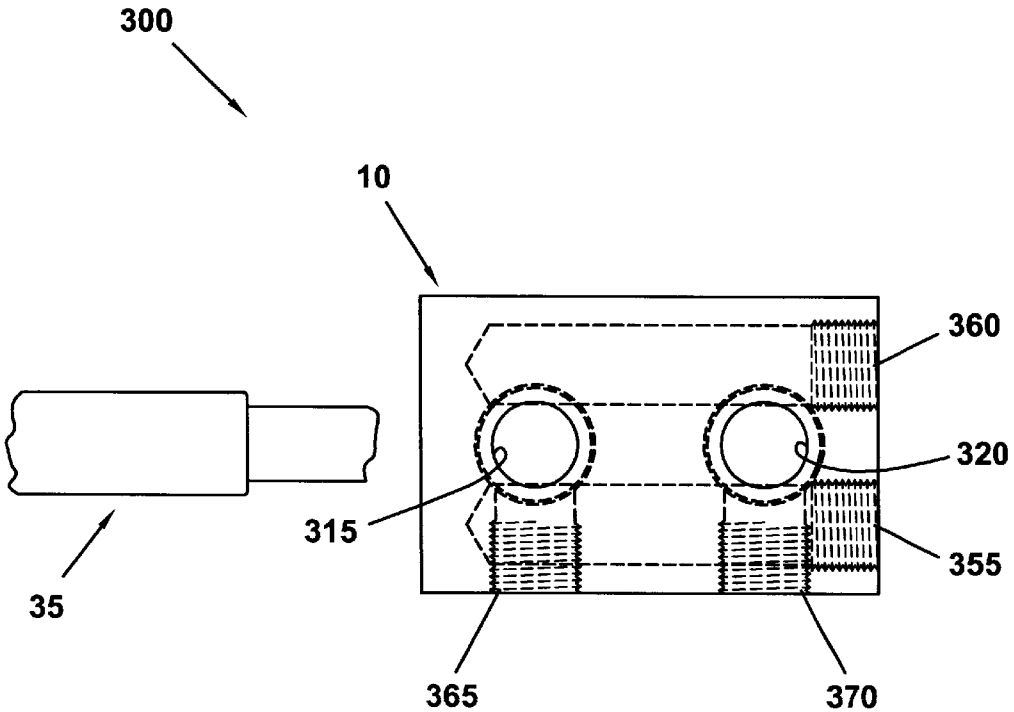
FIG. 9 is a top view of the preferred embodiment of FIG. 8.

A top view of the dual-spool hydraulic directional valve 300 of FIG. 8 is illustrated in FIG. 9. For purposes of clarity, the dual-spool hydraulic directional valve 300 is shown in FIG. 9 without the handle 35 and its connecting components. Supply port 355 and return port 360 can be seen to be in communication with the bores 315, 320 containing the valve spools 325, 330. The retract port 365 and the extend port 370 can be seen to be aligned with the valve spools 325 and 330 respectively.

Figure 10:
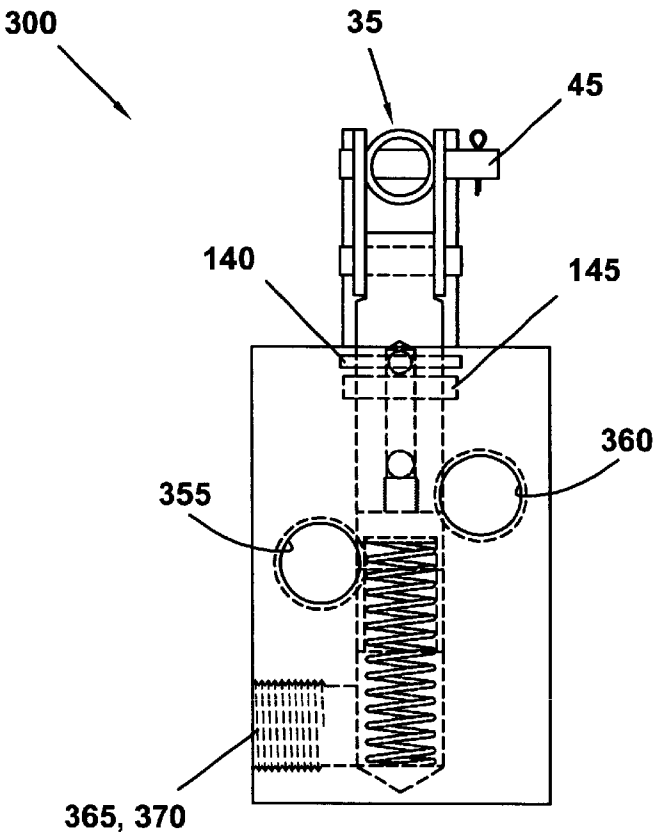
FIG. 10 is a right side view of the preferred embodiment of FIG. 8.

FIG. 10 depicts a right side view of the dual-spool hydraulic directional valve 300 shown in FIG. 10. The retract and extend ports 365, 370 can be seen to be aligned. In this embodiment the supply port 355 and return port 360 are preferably symmetrically located on either side of the longitudinal axis of the bores 315, 320. The supply port 355 and return port 360 are also preferably vertically offset, such that when the valve is in a neutral position (see FIG. 12), a lower portion of the return port 360 and an upper portion of the supply port 355 are in communication with a fluid passage (see FIG. 11) that extends through each of the valve spools 325, 330.

The dual-spool hydraulic directional valve 300 may employ a wiper 140 within the bores 315, 320 for cleaning debris from the valve spools 325, 330 as the valve spools travel up and down within the bores. A seal 145, such as an o-ring, is also preferably utilized to prevent any hydraulic fluid passing through the gap between the surface of the valve spools 325, 330 and the surface of the bores 315, 320 from escaping from the valve body 310.

Figure 11:
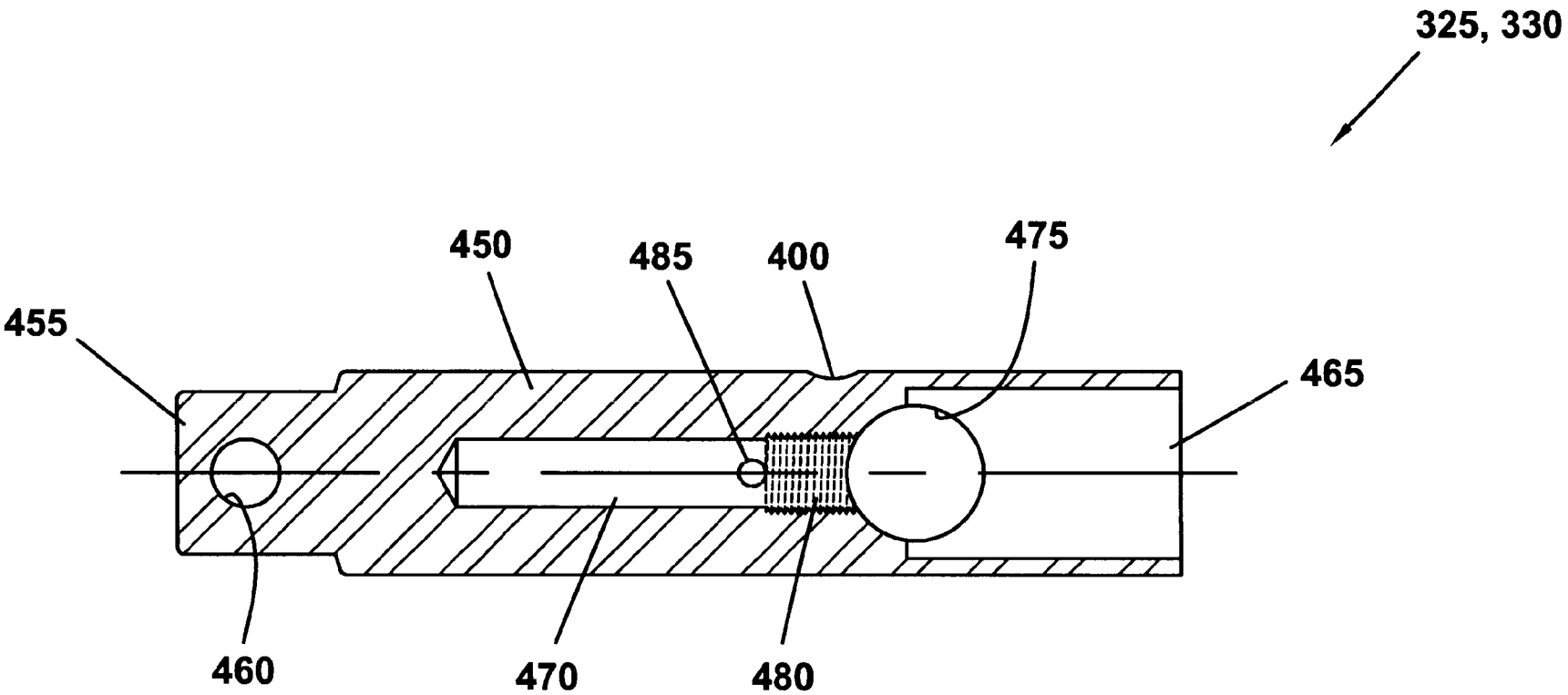
FIG. 11 is an enlarged cross-section of the valve spool seen in the preferred embodiments of FIGS. 8 and 10.

FIG. 11 is a section view of the valve spools 325, 330 shown in the alternate embodiment of FIGS. 8 and 10. The valve spools 325, 330 can be seen to have a cylindrical main body portion 450. The top portion 455 of the valve spools 325, 330, which is preferably of slightly smaller diameter than the main body 450, contains a hole 460 which passes completely through the top portion along a diameter of the valve spools. The hole 460 is provided to receive a pin portion of the linkage 50 that connects the valve spools 325, 330 to the handle 35.

Figure 12:
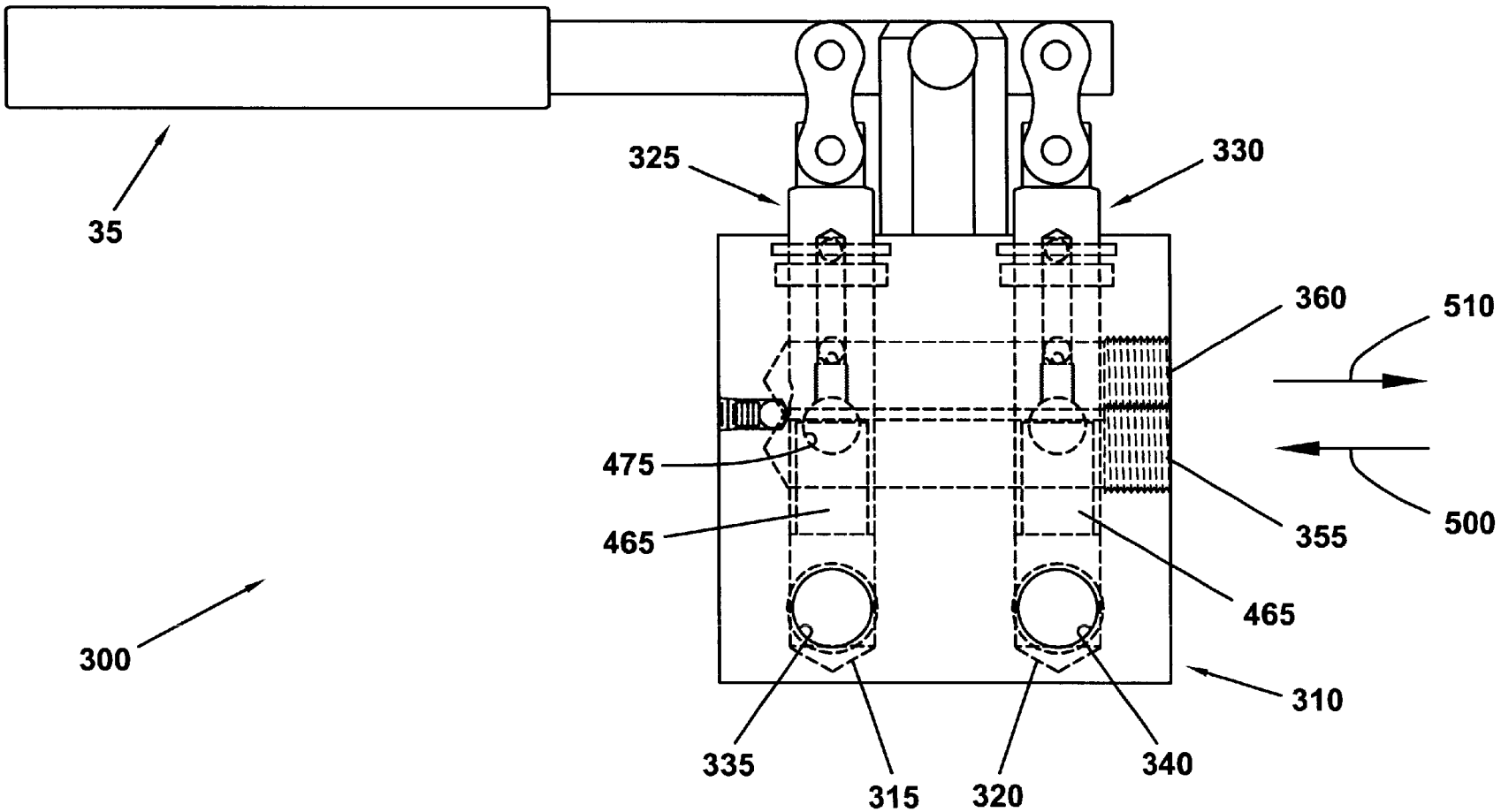
FIG. 12 illustrates the preferred embodiment of the dual-spool hydraulic directional valve of FIG. 8, wherein the valve is in a neutral position.

A counterbore 465 is preferably provided in the bottom of each valve spool 325, 330. The counterbore 465, which is centered about the axis of the valve spool, protrudes partially into the valve spools 325, 330, and is of a diameter slightly smaller than the diameter of the main body portion 450. The counterbore 465 is provided in each valve spool 325, 330 to retain a biasing spring 335, 340 which resides between the bottom of each valve spool and the bottom of the respective bores 315, 320. The biasing springs 335, 340 serve to influence each of the valve spools 325, 330 toward the neutral position (FIG. 12).

A fluid passage 475 extends through a diameter of each valve spool, and is located to be in communication with both a hollow 470 and the counterbore 465. The fluid passage 475 is preferably of a diameter slightly less than the diameter of the counterbore 465. A hollow 470 extends axially from the fluid passage 475 some distance toward the top portion 455 on each valve spool 325, 330. There is also a transverse portion 485 of the hollow 470, which extends from a diameter of the hollow through the surface of the valve spools 325, 330. The hollow 470 and fluid passage 475 located in each valve spool allow hydraulic fluid to pass through the valve spools.

A threaded segment 480 may be provided in the hollow 470 for receiving a threaded ball-seat (not shown). The ball-seat abuts a steel ball 405 (not shown in FIG. 11) which resides therein. The threaded segment 480 is preferably located between the fluid passage 475 and the transverse portion 485 of the hollow, so that when the steel ball 405 resides against the ball-seat, the steel ball will be substantially aligned with the transverse portion of the hollow.

Figure 14:
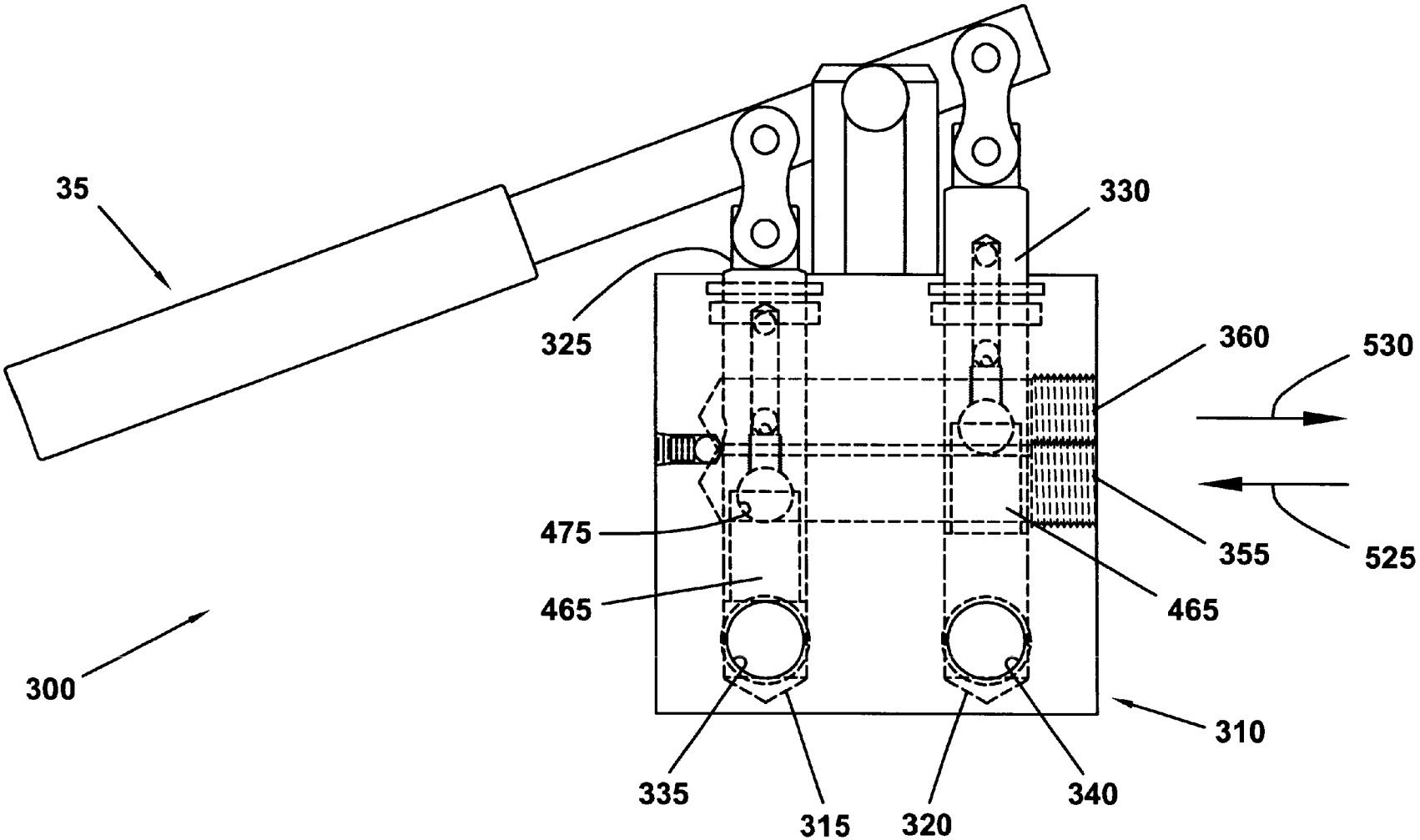
FIG. 14 illustrates the preferred embodiment of the dual-spool hydraulic directional valve of FIG. 8, wherein the valve is in a retract position.

The first valve spool 325 also preferably contains a notch 400 for engaging with the detent device 375 shown in FIG. 8. The detent device 375 and notch 400 serve to help retain the position of the first valve spool 325 when the dual-spool hydraulic directional valve 300 is in the retract position (FIG. 14).

The dual-spool hydraulic directional valve 300 can be seen in a "neutral" position by reference to FIG. 12. In the neutral position, the handle 35 is approximately parallel with the top surface of the valve body 310, such that the valve spools 325, 330 penetrate the valve body a relatively equivalent distance. In this position, hydraulic fluid from a pressurized source, such as a hydraulic pump, flows into the valve body 310 through inlet port 355, as illustrated by the arrow 500. Pressure exists in the lines (not shown) leading from the retract and extend ports 365, 370 to the hydraulic cylinder or other device connected to the valve 300. Because the pathway through the fluid passages 475 in each of the valve spools and into the return port 360 provides the path of least resistance, substantially all of the hydraulic fluid entering inlet port 355 will exit through the return port back to the hydraulic tank, as illustrated by the arrow 510. In the neutral position, hydraulic fluid may freely circulate from a hydraulic pressure source through the dual-spool hydraulic directional valve 300 without actuating any hydraulic devices attached thereto.

Figure 13:
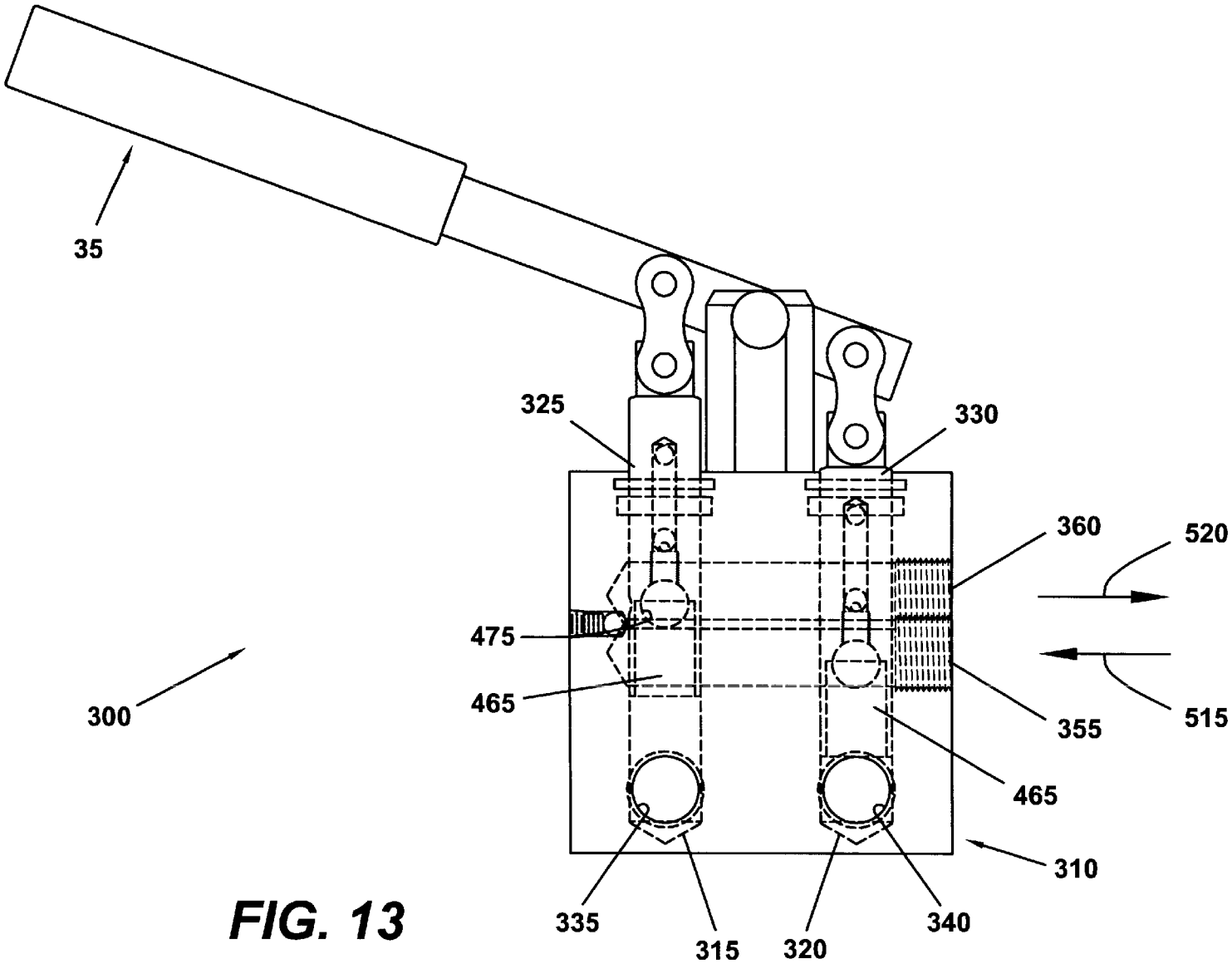
FIG. 13 illustrates the preferred embodiment of the dual-spool hydraulic directional valve of FIG. 8, wherein the valve is in an extend position.

FIG. 13 shows the dual-spool hydraulic directional valve 300 in an "extend" position. In the extend position, the handle 35 is raised, causing the first valve spool 325 to become partially removed from the valve body 310, while simultaneously driving the second valve spool 330 further into the valve body. Hydraulic fluid from a pressurized source, such as a hydraulic pump, flows into the valve body 310 through inlet port 355, as illustrated by the arrow 515. The hydraulic fluid will flow through the fluid passage 475 in the second valve spool 330, through the counterbore 465, and out the extend port 370. Entering hydraulic fluid is prevented from passing into the first bore 315 by the bottom portion of the first valve spool 325. If excess hydraulic pressure is applied to the supply port 355, a portion of the entering hydraulic fluid may pass through the ball seat in the hollow 470 of the second valve spool 330, thereby displacing the steel ball 405 and exiting into the return port 360 through the passageway 480.

Hydraulic fluid returns to the dual-spool hydraulic directional valve 300 from the retracting side of the hydraulic device connected thereto through the retract port 365. The returning hydraulic fluid travels up the first bore 315, through the counterbore 465 and fluid passage 475 located in the first valve spool 325, and exits the valve 300 from the return port 360, as indicated by the arrow 520. The returning hydraulic fluid is prohibited from entering supply port 355 through the hollow 470 in the second valve spool 330 by the steel ball 405 and ball seat.

FIG. 14 illustrates the dual-spool hydraulic directional valve 300 in a "retract" position. In the retract position, the handle 35 is depressed, causing the second valve spool 330 to become partially removed from the valve body 310, while simultaneously driving the first valve spool 325 into the valve body. In this position, the detent device 375 will engage with the notch 400 in the first valve spool to help retain the first valve spool in the retract position.

Hydraulic fluid from a pressurized source, such as a hydraulic pump, flows into the valve body 310 through inlet port 355, as illustrated by arrow 525. The hydraulic fluid will flow past the second valve spool 330, to the first bore 315. Upon reaching the first bore 315, the hydraulic fluid will enter the fluid passage 475 of the first valve spool 325, pass through the counterbore 465, and exit the retract port 365 to the hydraulic device connected to the dual-spool hydraulic directional valve 300. If excess hydraulic pressure is applied to the supply port 355, a portion of the entering hydraulic fluid may pass through the ball seat in the hollow 470 of the first valve spool 325, thereby displacing the steel ball 405 and exiting into the return port 360 through the passageway 480.

Hydraulic fluid returns to the dual-spool hydraulic directional valve 300 from the extending side of the hydraulic device connected thereto through extend port 370. The returning hydraulic fluid travels up the second bore 320, through the counterbore 465 and fluid passage 475 located in the second valve spool 330, and exits the valve 300 from the return port 360, as indicated by the arrow 530. The returning hydraulic fluid is prohibited from entering supply port 355 through the hollow 470 in the first valve spool 325 by the steel ball 405 and ball seat.

The present invention discloses a hydraulic directional valve that is less costly to manufacture, that may be more easily repaired, and that is more resistant to contamination than current hydraulic directional valves. Additionally, by utilizing two valve spools, a slight leakage of hydraulic fluid from one valve spool to the other will not affect the proper operation of the valve.

While certain preferred embodiments are described above, the scope of the invention is not to be considered limited by said disclosure, and modifications are possible without departing from the spirit of the invention as evidenced by the following claims.

What is claimed is:

1. A hydraulic directional valve, said valve comprising:

a valve body;

a supply passageway in said valve body;

a return passageway in said valve body;

a pair of outlet ports, one port for directing pressurized hydraulic fluid from said valve body to a hydraulic device while the other port is receiving pressurized hydraulic fluid from said hydraulic device;

a first bore in said valve body, said first bore connecting one of said outlet ports to said supply and return passageways;

a second bore in said valve body, said second bore connecting the other of said outlet ports to said supply and return passageways;

a first valve spool located in said first bore and a second valve spool located in said second bore, a portion of each of said valve spools of lesser outer dimension than the remainder thereof to allow the passage of hydraulic fluid; and a shifting apparatus for causing a change of position of said valve spools, such that as one of said valve spools is inserted into its bore, the other of said valve spools is simultaneously withdrawn from its bore.

2. The hydraulic directional valve of claim 1, wherein said valve body is of substantially parallelepipedic shape.

3. The hydraulic directional valve of claim 2, wherein the longitudinal axes of said bores lie on the same plane.

4. The hydraulic directional valve of claim 3, wherein said plane lies substantially on the centerline of at least one face of said valve body.

5. The hydraulic directional valve of claim 1, wherein said supply and return passageways are aligned in a plane parallel to said plane passing through the longitudinal axes of said bores.

6. The hydraulic directional valve of claim 1, wherein the longitudinal axes of each of said supply and return passageways are substantially symmetrically spaced about the longitudinal axes of said bores.

7. The hydraulic directional valve of claim 1, wherein the longitudinal axes of said outlet passageways are perpendicular to the longitudinal axes of said supply and return passageways.

8. The hydraulic directional valve of claim 7, wherein said outlet passageways are located such that their longitudinal axes are substantially centered between said supply and return passageways.

9. The hydraulic directional valve of claim 7, wherein said outlet passageways are located to communicate with substantially a bottom portion of said bores.

10. The hydraulic directional valve of claim 1, wherein said portion of lesser outer dimension on each of said valve spools is located such that each portion of lesser outer dimension is in substantially equal communication with each of said supply and return passageways when said directional valve is in a neutral position.

11. The hydraulic directional valve of claim 1, further comprising a passageway within said first and second valve spools, said passageway for transporting hydraulic fluid from said portion of lesser outer dimension on said valve spools through a bottom portion of said valve spools.

12. The hydraulic directional valve of claim 11, wherein said passageway contains a threaded segment for receiving a threaded plug, said plug for blocking the passage of hydraulic fluid through said valve spool.

13. The hydraulic directional valve of claim 11, further comprising a counterbore in said bottom portion of each of said first and second valve spools, said counterbore in communication with said passageway, and provided to retain a spring.

14. The hydraulic directional valve of claim 13, further comprising a spring residing between said counterbore in each of said first and second valve spools and the bottom of each bore, said spring for biasing said first and second valve spools upward.

15. The hydraulic directional valve of claim 1, wherein a fluid passage passes through a diameter of each of said first and second valve spools, said fluid passage for allowing hydraulic fluid to enter into each of said valve spools.

16. The hydraulic directional valve of claim 15, wherein said fluid passage is located such that said fluid passage on each of said first and second valve spools is substantially in equal communication with each of said supply and return passageways when said directional valve is in a neutral position.

17. The hydraulic directional valve of claim 15, further comprising a counterbore in a bottom portion of each of said valve spools, said counterbore in communication with said fluid passage, and provided to retain a spring.

18. The hydraulic directional valve of claim 17, further comprising a spring residing between said counterbore in each of said first and second valve spools and the bottom of each bore, said spring for biasing said first and second valve spools upward.

19. The hydraulic directional valve of claim 18, wherein said seal is an o-ring.

20. The hydraulic directional valve of claim 1, further comprising at least one detent device for engaging with a corresponding valve spool, such that said valve spool is urged to remain in its current position.

21. The hydraulic directional valve of claim 1, wherein said passageways in said valve body have a threaded portion for connection of said directional valve to various hydraulic devices.

22. The hydraulic directional valve of claim 1, further comprising a pressure relief valve.

23. The hydraulic directional valve of claim 22, wherein said pressure relief valve comprises:

a bore of differing diameters located in said valve body, said bore in communication with both of said supply passageway and said return passageway, and having a threaded portion;

a steel ball located within said bore of larger diameter to reside against said bore of smaller diameter;

a spring located within said bore of larger diameter to reside against said steel ball;

a set screw for biasing said spring against said steel ball and for retaining said spring and said steel ball within said bore; and a seal threaded into said bore for preventing hydraulic fluid from leaking from said pressure relief valve;

wherein at a predetermined pressure hydraulic fluid will displace said steel ball against said spring, thereby allowing at least a portion of said hydraulic fluid to pass from said supply passageway into said return passageway and out of said directional valve.

24. The hydraulic directional valve of claim 22, wherein said pressure relief valve comprises:

a hollow in each of said first and second valve spools, said hollow having a threaded portion;

a ball seat threaded into said threaded portion of said hollow for locating a steel ball;

a steel ball located within said hollow to abut said ball seat, said steel ball preventing communication between said fluid passage and said return passage from occurring through said hollow;

wherein at a predetermined pressure, hydraulic fluid displaces said steel ball away from said ball seat, thereby allowing at least a portion of said hydraulic fluid to pass from said supply passageway through said fluid passage and said hollow, into said return passageway, and out of said directional valve.

25. The hydraulic directional valve of claim 1, wherein said shifting apparatus is adapted to cause movement of said first valve spool in one direction, while simultaneously causing movement of said second valve spool in an opposite direction.

26. The hydraulic directional valve of claim 25, wherein said shifting apparatus is a handle.

27. The hydraulic directional valve of claim 25, wherein said shifting apparatus is a solenoid.

28. The hydraulic directional valve of claim 1, further comprising a wiper corresponding to each of said first and second valve spools, each of said wipers for preventing contaminants from entering said bores in said valve body.

29. The hydraulic directional valve of claim 1, further comprising a seal corresponding to each of said first and second valve spools, each of said seals for preventing hydraulic fluid from leaking from said bores in said valve body.

30. The hydraulic directional valve of claim 1, wherein said channel is located such that said channel on each of said first and second valve spools is in substantially equal communication with each of said supply and return passageways when said directional valve is in a neutral position.

31. The hydraulic directional valve of claim 30, further comprising a passageway within said first and second valve spools, said passageway for transporting hydraulic fluid from said channel through a bottom portion of said valve spool.

32. The hydraulic directional valve of claim 31, wherein said passageway contains a threaded segment for receiving a threaded plug, said plug for blocking the passage of hydraulic fluid through said valve spools.

33. The hydraulic directional valve of claim 32, further comprising a counterbore in said bottom portion of each of said first and second valve spools, said counterbore in communication with said passageway, and provided to retain a spring.

34. The hydraulic directional valve of claim 33, further comprising a spring residing between said counterbore in each of said first and second valve spools and the bottom of each bore, said spring for biasing said first and second valve spools upward.

35. A hydraulic directional valve, said valve comprising:

a valve body, said valve body further comprising:

a supply passageway for supplying hydraulic fluid to said directional valve;

a return passageway for expelling hydraulic fluid from said directional valve;

a first outlet passageways for the supply and return of hydraulic fluid between said directional valve and a first side of a hydraulic device connected thereto;

a second outlet passageway for the supply and return of hydraulic fluid between said directional valve and a second side of said hydraulic device;

a first bore in communication with said supply passageway, said return passageway, and said first outlet passageway;

a second bore in communication with said supply passageway, said return passageway, and said second outlet passageways;

a first valve spool and a second valve spool, said valve spools residing in said first and second bores respectively, said valve spools having a circumferential channel around a portion thereof; and a shifting apparatus coupled to each of said first and second valve spools, said shifting apparatus provided for causing a change of position of said valve spools within said valve body such that as one of said valve spools is inserted into its bore, the other of said valve spools is simultaneously withdrawn from its bore;

wherein insertion of said first valve spool into said first bore places said channel of said first valve spool into communication with said supply passageway, thereby allowing pressurized hydraulic fluid from a pressurized hydraulic fluid source to pass through said first bore and out said first outlet port to said hydraulic device, while an upper portion of said first valve spool simultaneously prevents pressurized hydraulic fluid from said source from entering said return passageway;

wherein said channel of said second valve spool is simultaneously placed into communication with said return passageway, thereby allowing pressurized hydraulic fluid from said hydraulic device to flow through said corresponding outlet port into said second bore and out said return passageway, while a lower portion of said second valve spool simultaneously prevents pressurized hydraulic fluid from said hydraulic device from entering said supply passageway and wherein flow through said valve is reversed when said shifting apparatus is moved in an opposite direction.

36. The hydraulic directional valve of claim 35, wherein said valve body is substantially parallelepipedic shape.

37. The hydraulic directional valve of claim 36, wherein the longitudinal axes of said first and second bore lie on the same plane.

38. The hydraulic directional valve of claim 37, wherein said plane lies substantially on the centerline of at least one face of said valve body.

39. The hydraulic directional valve of claim 36 wherein said supply and return passageways are aligned in a plane parallel to a plane passing through the longitudinal axes of said bores.

40. The hydraulic directional valve of claim 36, wherein the longitudinal axes of said outlet passageways are perpendicular to the longitudinal axes of said supply and return passageways.

41. The hydraulic directional valve of claim 36, wherein said outlet passageways are located such that their longitudinal axes are substantially centered between said supply and return passageways.

42. The hydraulic directional valve of claim 36, wherein said outlet passageways are located to communicate with substantially a bottom portion of said bores.

43. The hydraulic directional valve of claim 36, wherein a fluid passage passes through a diameter of each of said first and second valve spools, said fluid passage for allowing hydraulic fluid to enter into each of said valve spools.

44. The hydraulic directional valve of claim 43, wherein said fluid passage is located such that said fluid passage on each of said first and second valve spools is substantially in equal communication with each of said supply and return passageways when said directional valve is in a neutral position.

45. The hydraulic directional valve of claim 44, further comprising a counterbore in a bottom portion of each of said valve spools, said counterbore in communication with said fluid passage, and provided to retain a spring.

46. The hydraulic directional valve of claim 45, further comprising a spring residing between said counterbore in each of said first and second valve spools and the bottom of each bore, said spring for biasing said first and second valve spools upward.

47. The hydraulic directional valve of claim 36, further comprising at least one detent device for engaging with a corresponding valve spool, such that said valve spool is urged to remain in its current position.

48. The hydraulic directional valve of claim 36, wherein said passageways in said valve body have a threaded portion for connection of said directional valve to various hydraulic devices.

49. The hydraulic directional valve of claim 36, further comprising a pressure relief valve.

50. The hydraulic directional valve of claim 49, wherein said pressure relief valve comprises:

a bore in said valve body having both a larger and smaller diameter, said bore in communication with both of said supply passageway and said return passageway, and having a threaded portion;

a steel ball located within said bore of larger diameter to reside against said bore of smaller diameter;

a spring located within said bore of larger diameter to reside against said steel ball;

a set screw for biasing said spring against said steel ball and for retaining said spring and said steel ball within said bore; and a seal threaded into said bore for preventing hydraulic fluid from leaking from said pressure relief valve.

51. The hydraulic directional valve of claim 50, wherein said pressure relief valve comprises:

a hollow in each of said first and second valve spools, said hollow having a threaded portion;

a ball seat threaded into said threaded portion of said hollow for locating a steel ball;

a steel ball located within said hollow to abut said ball seat, said steel ball preventing communication between said fluid passage and said return passage from occurring through said hollow;

wherein at a predetermined pressure, hydraulic fluid displaces said steel ball away from said ball seat, thereby allowing at least a portion of said hydraulic fluid to pass from said supply passageway through said fluid passage and said hollow, into said return passageway, and out of said directional valve.

52. The hydraulic directional valve of claim 36, wherein said shifting apparatus is adapted to cause movement of said first valve spool in one direction, while simultaneously causing movement of said second valve spool in an opposite direction.

53. The hydraulic directional valve of claim 52, wherein said shifting apparatus is a handle.

54. The hydraulic directional valve of claim 52, wherein said shifting apparatus is a solenoid.

55. The hydraulic directional valve of claim 36, further comprising a wiper corresponding to each of said first and second valve spools, each of said wipers for preventing contaminants from entering said bores in said valve body.

56. The hydraulic directional valve of claim 36, further comprising a seal corresponding to each of said first and second valve spools, each of said seals for preventing hydraulic fluid from leaking from said bores in said valve body.

57. The hydraulic directional valve of claim 56, wherein said seal is an o-ring groove.

* * * * *